US010427000B1

(12) United States Patent
Miller et al.

(10) Patent No.: US 10,427,000 B1
(45) Date of Patent: Oct. 1, 2019

(54) EXERCISE AND REHABILITATION DEVICE

(71) Applicants: Daniel S. Miller, Omaha, NE (US); Anne Kintner, Harlan, IA (US)

(72) Inventors: Daniel S. Miller, Omaha, NE (US); Anne Kintner, Harlan, IA (US)

( * ) Notice: Subject to any disclaimer, the term of this patent is extended or adjusted under 35 U.S.C. 154(b) by 148 days.

(21) Appl. No.: 15/687,930

(22) Filed: Aug. 28, 2017

(51) Int. Cl.

| | |
|---|---|
| ***A63B 23/12*** | (2006.01) |
| ***A63B 21/00*** | (2006.01) |
| ***A63B 23/16*** | (2006.01) |
| ***A63B 23/14*** | (2006.01) |
| ***A63B 26/00*** | (2006.01) |

(52) U.S. Cl.
CPC ..... *A63B 23/12* (2013.01); *A63B 21/4017* (2015.10); *A63B 21/4019* (2015.10); *A63B 23/14* (2013.01); *A63B 23/16* (2013.01); *A63B 26/003* (2013.01)

(58) Field of Classification Search
CPC . A63B 21/4017; A63B 21/4019; A63B 23/12; A63B 23/14; A63B 23/16; Y10T 403/45; Y10T 403/54
See application file for complete search history.

(56) References Cited

U.S. PATENT DOCUMENTS

| | | | | |
|---|---|---|---|---|
| 6,616,554 | B2 * | 9/2003 | Liao | A63B 69/0075 473/417 |
| 7,090,626 | B1 | 8/2006 | Miller | |
| 7,686,699 | B2 * | 3/2010 | Snyders | A63B 69/0059 473/215 |
| 8,246,483 | B2 * | 8/2012 | Garno | A63B 53/00 473/300 |
| 9,457,216 | B2 * | 10/2016 | Lagree | A63B 21/0004 |
| 2003/0013586 | A1 * | 1/2003 | Rothschild | A63B 23/12 482/117 |
| 2011/0218058 | A1 * | 9/2011 | Gangelhoff | A63B 69/00 473/417 |

* cited by examiner

*Primary Examiner* — Megan Anderson
(74) *Attorney, Agent, or Firm* — Dennis L. Thomte; Thomte Patent Law Office LLC

(57) ABSTRACT

The exercise and rehabilitation device of the present invention includes a telescopic tube, having a first tube with upper and lower ends, and a second tube, having upper and lower ends, telescopically received in the upper end of the first tube. The lower end of the first tube has a base plate secured thereto by a joint which may be flexible or rigid. An open hand support may be secured to the upper end of the second tube by a flexible joint. A closed hand support may be secured to the upper end of the second tube by a double-ball mounting assembly. A forearm support may be secured to the upper end of the second tube by the double-ball mounting assembly.

4 Claims, 6 Drawing Sheets

EXERCISE AND REHABILITATION DEVICE

BACKGROUND OF THE INVENTION

Field of the Invention

The present invention relates to an exercise and rehabilitation device, and more particularly to a telescopically adjustable exercise and rehabilitation device that selectively removably receives one or more attachments or devices for the application of therapeutic exercises and/or rehabilitation of an individual's upper extremities.

Description of the Related Art

According to the research of the American Heart Association, each year, about 795,000 people experience a new or recurrent stroke. Strokes are a leading cause of serious long-term disability in the US, leading to impaired function often as a consequence of both sensory and motor deficits.

Historically, regaining lost function in the upper extremities post stroke was secondary to regaining essential functional recoveries such as improving balance, gait and general mobility. However, advances in scientific research and a resultant greater understanding of the brain's plasticity or adaptability to rehabilitate post the onset of a cerebral vascular accident or stroke, is offering survivors and their medical practitioners substantive new knowledge from which to base both clinically indicated and meaningfully therapeutic influences. Attempts to utilize this new understanding however has revealed limitations in current technology to both effectively as well as efficiently implement this evidence based therapeutic benefit. It is generally accepted that neural factors play an important role in muscle strength gains. For patients with pathologically induced muscular weakness, utilizing a mechanism towards re-balancing neuro-motor coordination lies in identifying the most supportive means of assisting motion within a therapeutic threshold, defined as therapeutically influencing targeted neuro-muscular responses without promotion of substitutions thus restoring healthy motor coordinations and resultant healthy biomechanics. This invention's capacity to meet each individual at their current impairment level and support functional motions while simultaneously influencing true healing enables optimization of this new research in an accessible way for the individual that does not exist within current assistive motion devices.

Devices currently offered to support rehabilitation on the part of the patient and his or her treating therapist include a self-assisted pulley system, a self-assisted rigid bar (i.e., a cane, T-bar, or broom handle); table top skate boards, variable sized exercise balls, and various automated robotic devices. Each of these devices for variable reasons fail to preserve the integrity of therapeutic intervention, that of the capacity to reach a patient at their source of pathological impairment of functional loss while simultaneously preserving a therapeutic threshold within an exercise intervention. This is vital as studies consistently find that reorganization of neural mechanism is a dynamic process that is influenced by a person's active efforts to meet environmental and task demands.

Axial based movement activity of one's periphery fosters new centrally located synapses and/or promotes alternate synapses and circuits (neuroplasticity) resulting in improved motor activation. Not all plasticity is adaptive or desirable; some is maladaptive. The brain, however, cannot judge whether these functions will be adaptive or maladaptive. For example, the brain will learn a well-executed motoric movement sequence and a poorly executed sequence equally well. Since the brain is primed to learn to represent function, care must be taken to ensure that the only stimuli presented are those that will encourage adaptive or pro-social functions, lest the wrong functions or responses be learned. Thus, to produce the most meaningful changes in the motor cortex of the brain, the therapist must encourage the meaningful functional use of the hemiparetic upper extremity and its underlying foundational requirements. This capacity is lacking in the current devices and, while the advancements of robotic technology attempt to match this requirement, their software is unable to fully mirror a person's volitionally produced intentions/combined human kinematics and thus a robotic induced support of mobility ultimately reflects the limits of combined mechanically automated computer technology.

Applicant's earlier device, which is described in U.S. Pat. No. 7,090,626, represented an improvement in the art. The instant invention represents a further improvement in the art.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A device for exercising or rehabbing a hand, arm, shoulder and upper extremity of a user or related joints is disclosed. The device includes an elongated first tube, having a lower end and an upper end, and an elongated second tube, having a lower end and an upper end, which is telescopically slidably received in the upper end of the first tube. A locking collar is provided at the upper end of the first tube for selectively locking the second tube in various telescopic positions with respect to the first tube. The device also includes a base plate which is spaced from the lower end of the first tube with the base plate having an inner side and an outer side. A first joint interconnects the inner side of the base plate at the lower end of the first tube. In one embodiment, the first joint is rigid. In a second embodiment, the first joint is a flexible joint. In one embodiment of this invention, an open hand support is provided which has an upper side and a lower side. This embodiment also includes a first flexible joint having upper and lower ends with the first flexible joint interconnecting the upper end of the second tube with the lower side of the open hand support.

In another embodiment of the invention, a first ball joint member is provided which has upper and lower ends with the first ball joint member including a first ball member having a cylindrical mounting portion extending downwardly therefrom with the cylindrical mounting portion of the first ball joint member being received and selectively removably secured to the upper end of the second tube. A double-ball mounting assembly is provided which includes a first elongated plate or connector member having an outer side, an inner side, an upper end and a lower end. The first elongated plate has a lower ball socket formed therein and an upper ball socket formed therein. The double-ball mounting assembly also includes a second elongated plate or connector member having an outer side, an inner side, an upper end and a lower end with the second elongated plate having a lower ball socket formed therein and an upper ball socket formed therein. The lower ball socket of the first plate is opposed to the lower ball socket of the second plate whereby a ball may be positioned therebetween. The upper ball socket of the first plate is opposed to the upper ball socket of the second plate whereby a ball may be positioned therebetween. Means is provided for connecting the first and second plates for selectively moving the first and second plates towards one another to a ball clamping position and for selectively moving the first and second plates away from another to a ball adjustment position. The lower ball sockets of the first and second plates are configured to receive the first ball member of the first ball joint member therebetween. The embodiment also includes a closed hand support having upper and lower ends with the closed hand support having a ball secured to the lower end thereof. The ball of the closed hand support may be received between the upper ball sockets of the first and second plates. The closed hand support is movable in a swivel manner with respect to the first and second plates of the double-ball mounting assembly. The first and second plates are mounted on the ball of the first ball joint member in a swivel manner.

In another embodiment, the closed hand support is replaced by a forearm support which has a ball at the lower end thereof which may be received between the upper ball sockets of the first and second plates.

It is therefore a principal object of the invention to provide an improved exercise and rehabilitation device.

A principal object of this invention is "therapeutic advancement" by creating a new rehabilitation device that meets the needs and matches the level of advancement in rehabilitation protocols being influenced by current neurological research in innovative ways.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
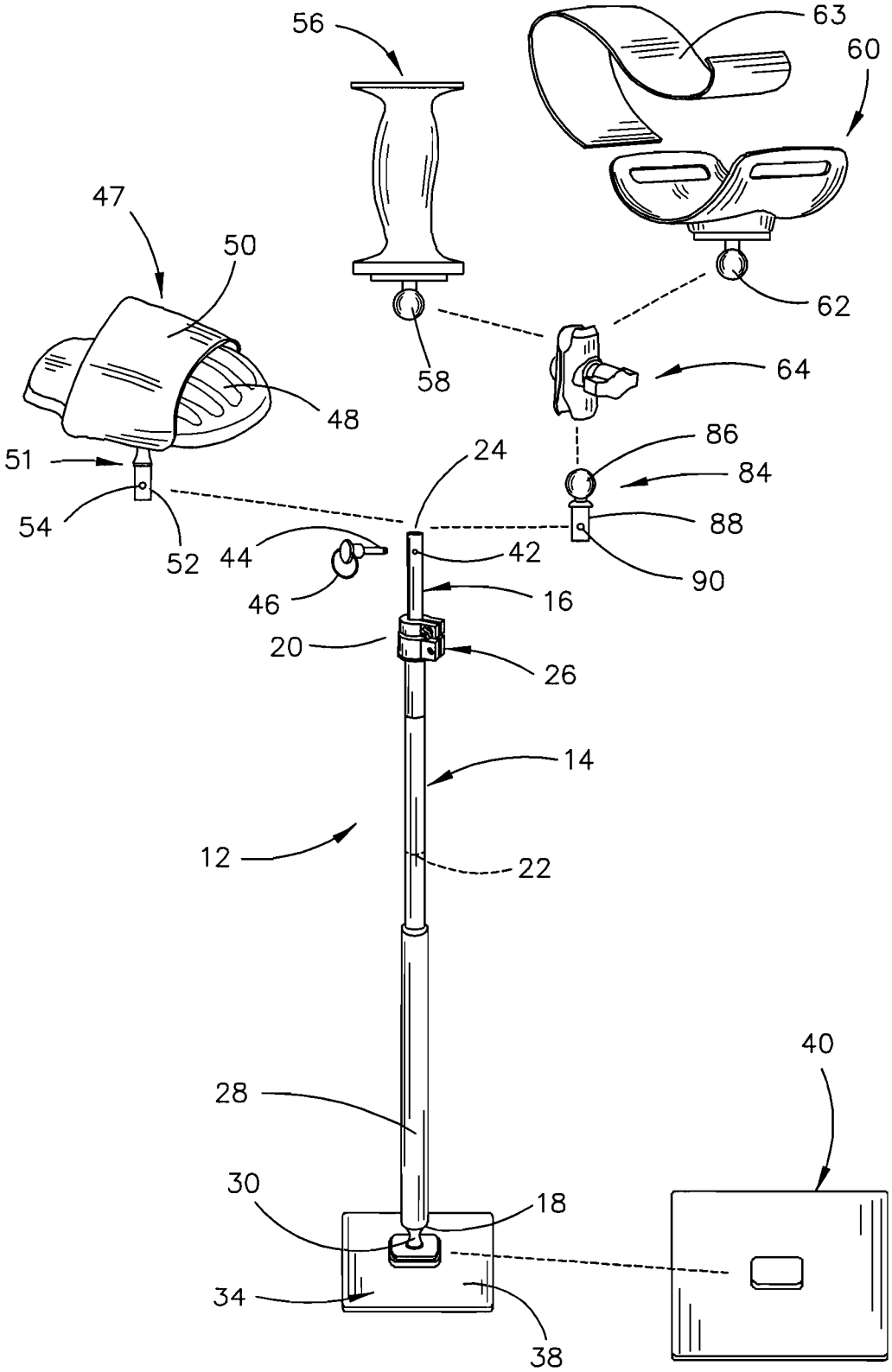
FIG. 1 is a partial exploded perspective view of the exercise device of this invention together with the various devices which may be utilized in the invention.
Figure 2:
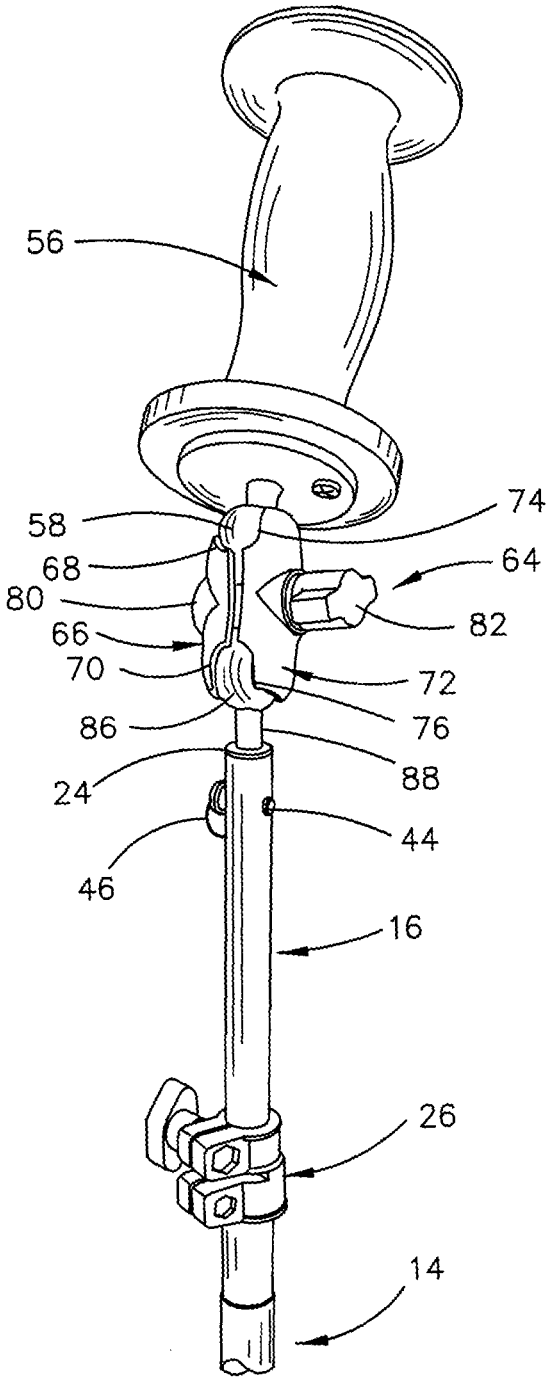
FIG. 2 is a partial perspective view illustrating the inner end of the exercise device of this invention and which has a closed hand support secured thereto.
Figure 3:
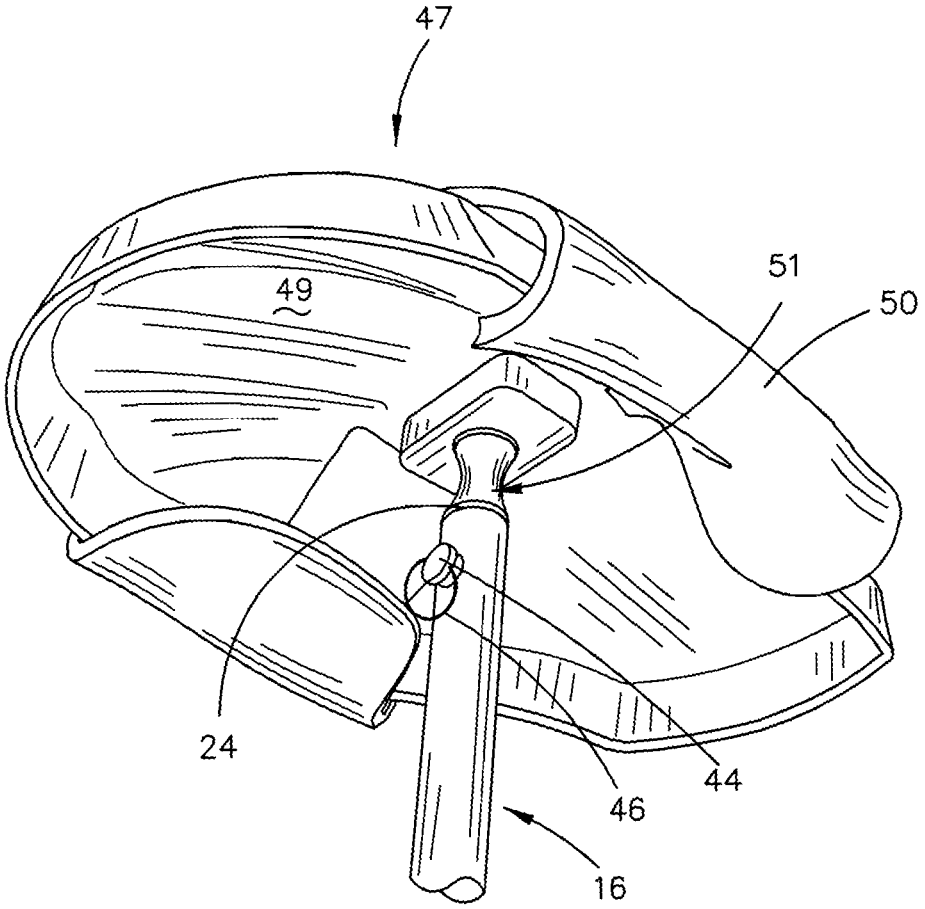
FIG. 3 is a partial perspective view of the inner end of the exercise device of this invention which has an open hand support secured thereto.
Figure 4:
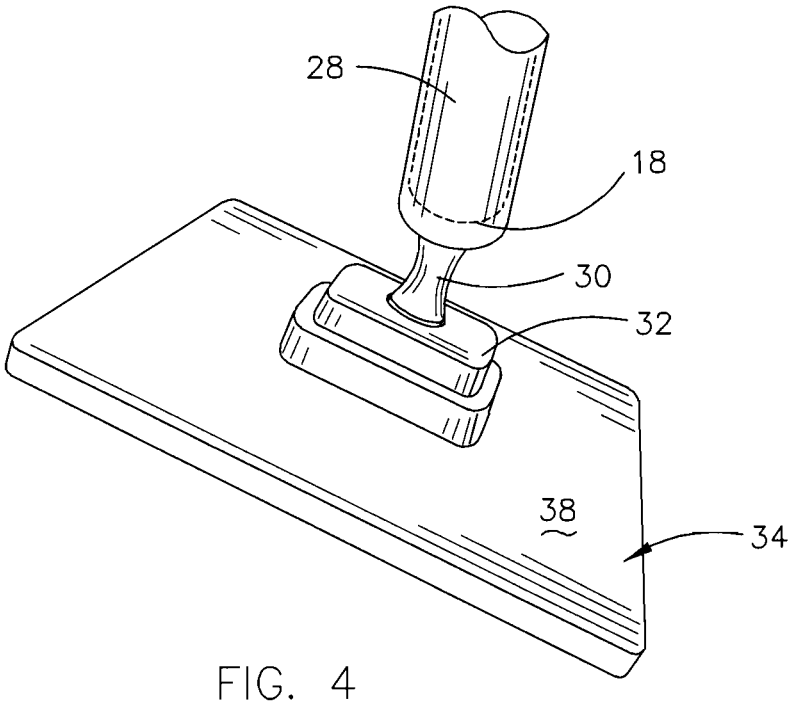
FIG. 4 is a partial perspective view of the outer end of the exercise device having a support plate secured thereto.
Figure 5:
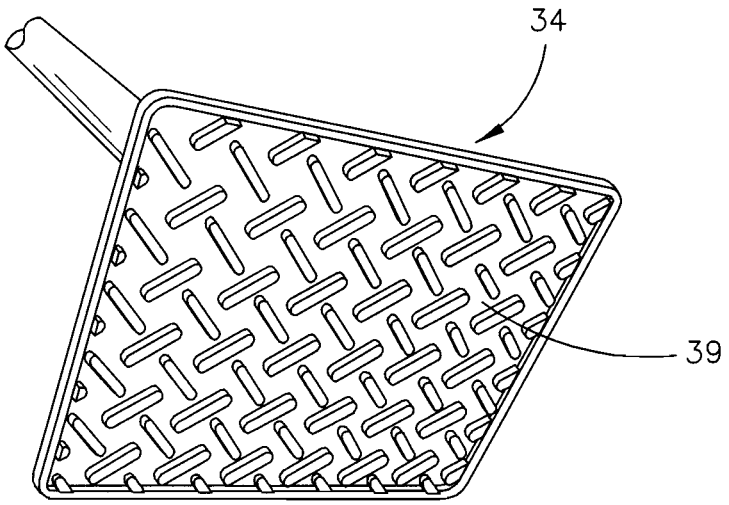
FIG. 5 is a bottom perspective view of the support plate of FIG. 4.
Figure 6:
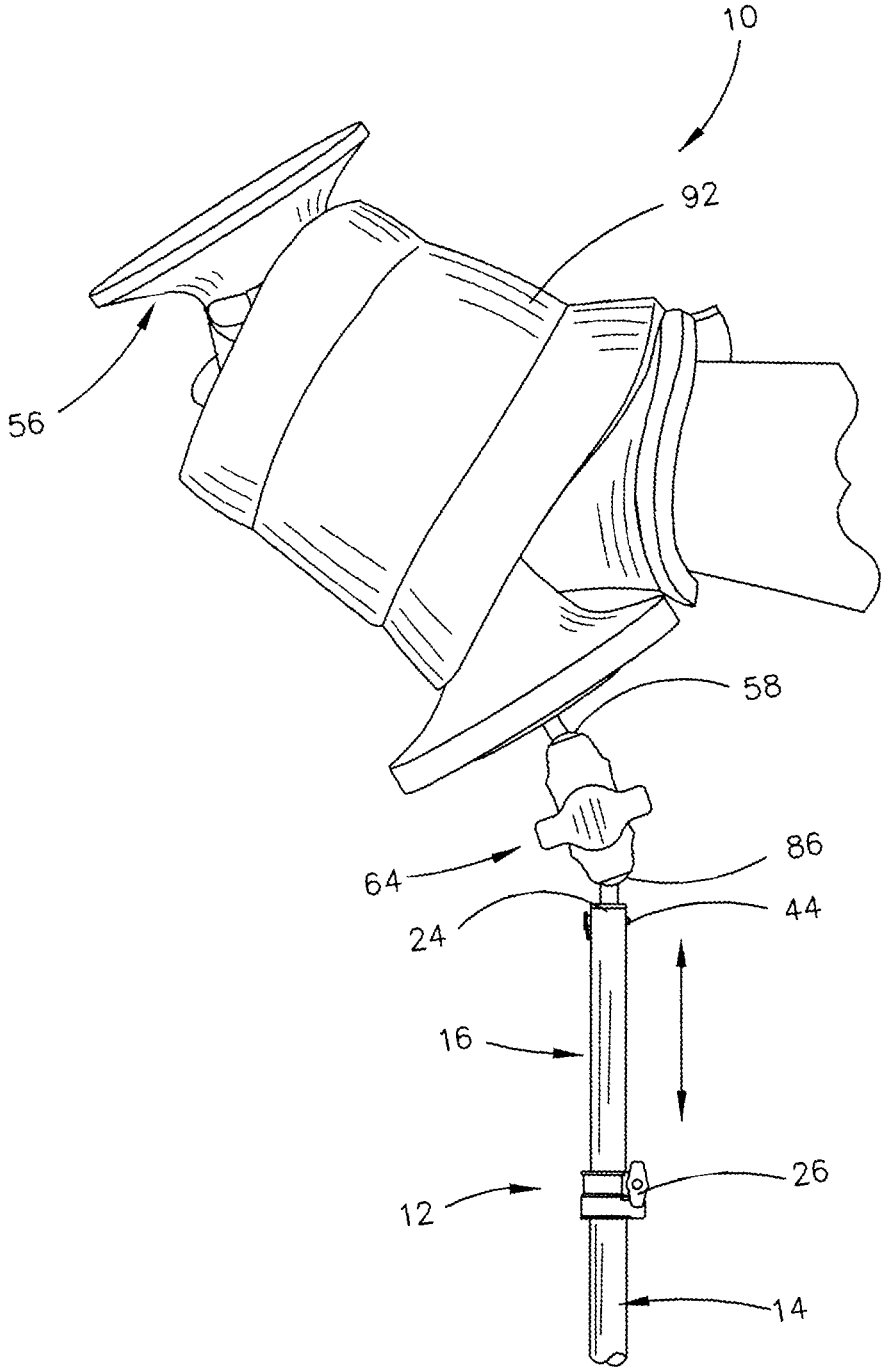
FIG. 6 is a partial perspective view of the inner end of the exercise device having a closed hand support secured thereto together with a strap means for securing the closed hand support to the user's hand.
Figure 7:
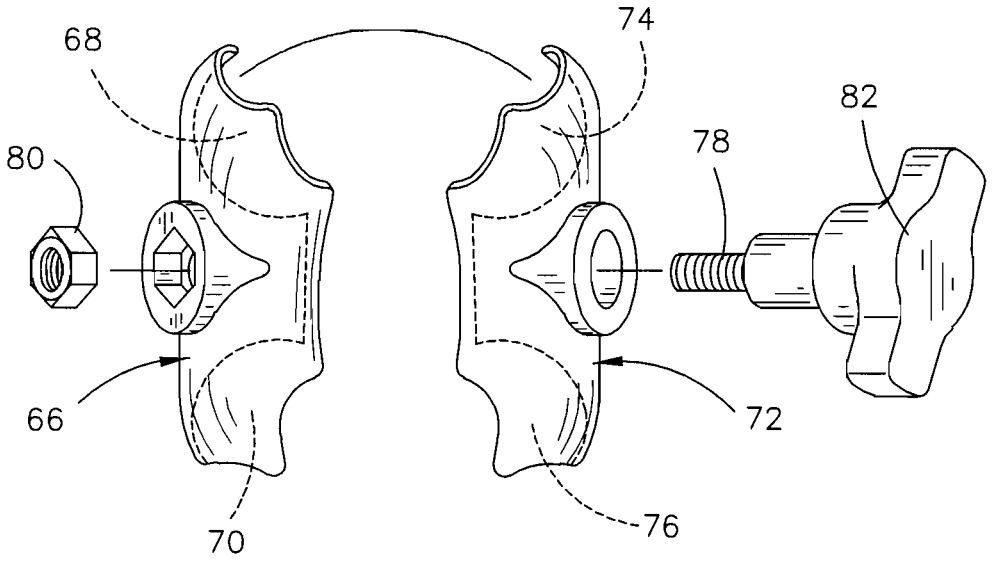
FIG. 7 is an exploded perspective view of the double-ball joint assembly of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The exercise and rehabilitation device of the present invention is generally designated by the number 10. For the purposes of description only, the exercise device 10 will be described as an instrument to be used by a patient for the rehabilitation of an injured upper extremity or by a stroke survivor. It is contemplated that the exercise or rehabilitation device 10 can be used for purposes other than rehabilitation, such as the exercising of an individual's upper extremities for strength, toning, or agility-building purposes. Moreover, it is further contemplated that the exercise device 10 could be used in the therapy of patients having a degenerative condition or other physical impairment other than an injury to an otherwise healthy upper extremity.

The exercise device 10 of this invention is preferably comprised of a longitudinally telescopic tube assembly 12 including a lower hollow tube member 14 and an upper hollow tube member 16 which is selectively slidably mounted in tube member 14 in a telescopic manner. For purposes of description, tube member 14 will be described as having a hollow lower end 18 and an upper end 20. Also for purposes of description, tube member 16 will be described as having a lower end 22 and an upper end 24. A conventional locking collar 26 embraces the upper end 20 of tube member 14. Locking collar 26, when in its untightened position, permits tube member 16 to be telescopically moved with respect to tube member 14. When locking collar 26 is in its tightened position, tube member 16 is prevented from telescopic movement with respect to tube member 14 in a conventional fashion.

The numeral 28 refers to an elongated handle which embraces tube member 14 at its lower end 18. Preferably, handle 28 is comprised of a foam material. The numeral 30 refers to a flexible joint comprised of rubber, plastic, etc. Joint 30 includes a generally rectangular pad 32 at its outer end. The flexible joint member 30 extends upwardly from pad 32 and has a cylindrical portion extending upwardly therefrom. The cylindrical portion of joint member 30 is press-fitted into the hollow outer end 18 of tube member 14. The numeral 34 refers to a base plate which has an inner side 38 and an outer side 39. Pad 32 is secured to the inner side 38 of base plate 34 by any convenient means. Alternatively, a larger base plate 40 may be utilized rather than the small base plate 34. If the large base plate 40 is employed, the joint associated therewith will be more rigid. Joint 30 permits articulating movement of base plate 34 while the joint associated with base plate 40 restricts or limits the articulating movement of the base plate 40 in all planes of movement.

The end 24 of tube member 16 has a bore or pin opening 42 formed therein which extends therethrough which is configured to receive a conventional quick release pin 44 therein. Pin 44 has a ring 46 attached thereto. The numeral 48 refers to an open hand support having an upper side 50 and a lower side 52. A strap 54 is attached to the open hand support for maintaining the user's hand thereon. A flexible joint 56 has its upper end secured to the lower side 52 of open hand support 48. Joint 56 includes a cylindrical portion 58 which is received in the open upper end 24 of tube 16. Cylindrical portion 58 has a pin opening 60 formed therein for receiving pin 44 therein.

The numeral 56 refers to a closed hand support having a joint ball 58 at its inner or lower end. The numeral 60 refers to a forearm support having a joint ball 62 at its inner or lower end. The supports 56 or 60 may be secured to the inner end 24 of tube member 16 by a conventional double ball connector 64. Connector 64 includes a first plate or connector member 66 which has semi-circular ball receiving sockets 68 and 70 at its opposite ends. Connector 64 also includes a second plate or connector member 72 having semi-circular ball receiving sockets 74 and 76 formed therein which register with sockets 68 and 70 respectively.

A threaded shaft 78 extends inwardly through the second connector member 72 and is threadably received by a nut 80 fixed to first connector member 66. A knob 82 is secured to the outer end of shaft 78. When shaft 78 is rotated in a first direction, the connector members 66 and 72 are moved towards one another. When shaft 78 is rotated in an opposite direction, the connector members 66 and 72 move away from one another.

When either the closed hand support 56 or the forearm support 60 is going to be used, a ball joint 84 is utilized. Ball joint 84 includes a joint ball 86 and a cylindrical portion 88. Cylindrical portion 88 includes a pin opening 90 formed therein. Cylindrical portion 88 is inserted into the open end 24 of tube 16 and the pin 44 is inserted into pin opening 42 to secure ball joint 84 in tube 16.

When closed hand support 56 is going to be used with the device, the shaft 78 is rotated to move the connector members 66 and 72 away from one another. The ball 86 of ball joint member 84 is positioned in the sockets 70 and 76 of connector members 66 and 72 respectively. The ball 58 of hand support 56 is positioned in the sockets 68 and 74. The knob 82 is then rotated to clamp the balls 86 and 58 in the connector 64. The double ball connector 64 permits the closed hand support 56 to be positioned in various positions since the connector 64 may be moved in several directions with respect to tube member 16 and since the closed hand support 56 may be moved in several directions and positions with respect to connector 64. The same is also true with respect to forearm support 60. If desired, a strap 92 may be employed to securely maintain the users hand in position on the hand support 56. A strap 63 may be used with the forearm support 60 to maintain the users forearm in the forearm support 60.

The instant invention truly represents a significant advance in the exercising and rehabilitation art. This invention provides a new rehabilitation device that meets the needs and matches the level of advancement in rehabilitation protocols being influenced by current neurological research in the following ways:

A. The resting alignment of a person's upper extremity, post stroke is highly variable. Utilizing this invention's multiplane bi articular positioning apparatus accommodates such a critical element with an external support that provides therapeutic influence that does not interfere (at rest) with a patient's baseline motor tone and resultant postural resting alignment. This offers the capacity to intervene or otherwise condition meaningful change without promotion of deleterious of otherwise conflicting forces.

B. Multiplane articulating joints (with graded durometers) within the base plate provides a graded resistance to angular displacements or rather application bending. This capacity from highest resistance of change to least resistance of change provides an initial near rigid stable upright application when a patient is most in need of stability. As a person gains in their own dynamic stabilization, the resistance can be lessened to appropriately condition further change of dynamic control.

C. This invention has the capacity to progress with the individual through the multitude of rehabilitation stages and goals thus offering a single device versus the need for multiple exercise devices.

Other physical aspects of this invention that support and enhance the innovation of aforementioned A, B, and C are as follows:

1. TELESCOPIC SUPPORTIVE AND GUIDANCE TUBING WITH ADJUSTING LOCKING COLLAR designed to support multiple patient applications with consideration of all healing stages, desired intensity levels, skill levels, and varying current upper extremity joint mobility measurements. This telescoping tube allows the patient to adjust the height to not only accommodate use whether standing, sitting or side lying, it also allows for optimal full extremity positioning in all uses. This eliminates the obstacles of improper chair to table height ratios therefore offering optimal therapeutic influences. The unweighting technology of this guidance tubing counteracts the effects of gravity while facilitating and promoting more meaningful functional movement. Additionally, by "unweighting" the limb, compensation and fatigue are minimized thereby intensifying treatment and driving neural changes.

2. FOREARM/WRIST CUFF SUPPORT WITH MULTIPLANE BI ARTICULAR POSITIONING APPARATUS designed to offer a generalized unweighting of the upper extremity with freedom of impedance through the distal forearm and hand. Once the desired wrist or forearm position is determined and strapped onto the cuff, the remaining upper extremity posture can be accommodated and secured in a multitude of kinetic chain relational alignments. This support offers a variety of therapeutic influences to be imparted distally as well as proximally in terms of either integrating distal functional capacities as well as perhaps accommodating transitional mobility restraints of the hand and wrist.

3. CLOSED HAND SUPPORT WITH MULTIPLANE BI ARTICULAR POSITIONING APPARATUS designed to accommodate a variable grasped posture that can be mechanically positioned and secured in a multitude of compatible kinetic chain relational alignments. This support offers a variety of hand configuration options and resultant therapeutic influences depending on how the hand is positioned over the support. Rotate the support within the patient's hand to find the most therapeutic and accommodating position and secure the hand with the strap. This support offers a variety of therapeutic influences to be imparted in concert perhaps with transitional mobility restraints of the hand and wrist. Further, within such current mechanical constraints, functional weight-bearing influences via closed chain applications offers proximal targeted applications. Still further as distal coordinated motion returns, grasp and reach applications are made available through this relational support.

4. OPEN HAND SUPPORT WITH MULTI-PLANE ARTICULATING JOINT designed to support the natural fluid relational motions of each joint of the upper extremity (shoulder girdle, elbow, forearm, and wrist) during open and closed chain kinetic functional applications. Combined with the securing strap, this support eliminates the gripping requirement and the potential negative influence of superfluous muscle activity elicited at the rotator cuff. Eliminating motor recruitment other than that required for the balance of dynamic stabilization and initiation of movement enables the patient to sense an accurate and appropriate progression of motor activation for a given movement. Further, emphasis of utilizing this support when applicable is desired for preserving suppleness of both soft tissue length and motor tone through the full upper extremity.

5. NON-INVOLVED HAND SUPPORT designed to support the guidance and force produced by the non-involved upper extremity in multiple open chain kinetic functional applications.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. A device for exercising or rehabilitating a hand, arm, shoulder or related joints of a user, comprising:

a flat base plate having an upper side and a lower side;

a first flexible joint comprising a horizontally disposed pad having an upper side and a lower side, and a cylindrical portion having an upper end and a lower end, which extends upwardly from said horizontally disposed pad;

said horizontally disposed pad being secured to said flat base plate;

an elongated lower tube having an open lower end and an open upper end;

said cylindrical portion of said first flexible joint extending upwardly into said open lower end of said elongated lower tube and being secured to said open lower end of said elongated lower tube;

an elongated upper tube having an open upper end and a lower end;

said elongated upper tube telescopically slidably extending downwardly into said open upper end of said elongated lower tube;

a locking collar at said open upper end of said elongated upper tube for selectively locking said elongated upper tube in various telescopic positions with respect to said elongated lower tube;

an open hand support having an upper side and a lower side;

a second flexible joint having an upper end and a cylindrical portion which extends downwardly from said upper end of said second flexible joint;

said upper end of said second flexible joint being secured to said lower side of said open hand support; and said cylindrical portion of said second flexible joint extending downwardly into said open upper end of said elongated upper tube and being secured thereto.

2. The device of claim 1 wherein an elongated foam tube embraces said elongated lower tube at said open lower end thereof.

3. A device for exercising or rehabilitating a hand, arm, shoulder or related joints of a user, comprising:

a flat base plate having an upper side and a lower side;

a first flexible joint comprising a horizontally disposed pad having an upper side and a lower side, and a cylindrical portion having an upper end and a lower end, which extends upwardly from said horizontally disposed pad;

said horizontally disposed pad being secured to said flat base plate;

an elongated lower tube having an open lower end and an open upper end;

said cylindrical portion of said first flexible joint extending upwardly into said open lower end of said elongated lower tube and being secured to said open lower end of said elongated lower tube;

an elongated upper tube having an open upper end and a lower end;

said elongated upper tube telescopically slidably extending downwardly into said open upper end of said elongated lower tube;

a locking collar at said open upper end of said elongated upper tube for selectively locking said elongated upper tube in various telescopic positions with respect to said elongated lower tube;

a first ball joint member having upper and lower ends;

said first ball joint member including a first ball member having a cylindrical mounting portion extending downwardly therefrom;

said cylindrical mounting portion of said first ball joint member being received in and selectively removably secured to said open upper end of said elongated upper tube;

a double-ball mounting assembly including a first elongated plate having an outer side, an inner side, an upper end and a lower end;

said first elongated plate having a lower ball socket formed therein and an upper ball socket formed therein;

said double-ball mounting assembly including a second elongated plate having an outer side, an inner side, an upper end, and a lower end;

said second elongated plate having a lower ball socket formed therein and an upper ball socket formed therein;

said lower ball socket of said first elongated plate being opposed to said lower ball socket of said second elongated plate whereby said first ball member is configured to be positioned therebetween;

said upper ball socket of said first elongated plate being opposed to said upper ball socket of said second elongated plate whereby a ball is configured to be positioned therebetween;

means connecting said first elongated plate and said second elongated plate for selectively moving said first elongated plate and said second elongated plate towards one another to a ball clamping position and for selectively moving said first elongated plate and second elongated plate away from one another to a ball adjustment position;

said lower ball sockets of said first elongated plate and said second elongated plate configured to receive said first ball member of said first ball joint member therebetween;

a closed hand support having upper and lower ends;

said closed hand support having a ball secured to its said lower end;

said ball of said closed hand support being received between said upper ball sockets of said first and second elongated plates of said double-ball mounting assembly;

said closed hand support being movable in a swivel manner with respect to said first elongated plate and said second elongated plate of said double-ball mounting assembly; and said first elongated plate and said second elongated plate of said double-ball mounting assembly being mounted on said first ball member of said ball joint member in a swivel manner.

4. A device for exercising or rehabilitating a hand, arm, shoulder or related joints of a user, comprising:

a flat base plate having an upper side and a lower side;

a first flexible joint comprising a horizontally disposed pad having an upper side and a lower side, and a cylindrical portion having an upper end and a lower end, which extends upwardly from said horizontally disposed pad;

said horizontally disposed pad being secured to said flat base plate;

an elongated lower tube having an open lower end and an open upper end;

said cylindrical portion of said first flexible joint extending upwardly into said open lower end of said elongated lower tube and being secured to said open lower end of said elongated lower tube;

an elongated upper tube having an open upper end and a lower end;

said elongated upper tube telescopically slidably extending downwardly into said open upper end of said elongated lower tube;

a locking collar at said open upper end of said elongated upper tube for selectively locking said elongated upper tube in various telescopic positions with respect to said elongated lower tube;

a first ball joint member having upper and lower ends;

said first ball joint member including a first ball member having a cylindrical mounting portion extending downwardly therefrom;

said cylindrical mounting portion of said first ball joint member being received in and selectively removably secured to said open upper end of said elongated upper tube;

a double-ball mounting assembly including a first elongated plate having an outer side, an inner side, an upper end and a lower end;

said first elongated plate having a lower ball socket formed therein and an upper ball socket formed therein;

said double-ball mounting assembly including a second elongated plate having an outer side, an inner side, an upper end, and a lower end;

said second elongated plate having a lower ball socket formed therein and an upper ball socket formed therein;

said lower ball socket of said first elongated plate being opposed to said lower ball socket of said second elongated plate whereby said first ball member is configured to be positioned therebetween;

said upper ball socket of said first elongated plate being opposed to said upper ball socket of said second elongated plate whereby a ball is configured to be positioned therebetween;

means connecting said first elongated plate and said second elongated plate for selectively moving said first elongated plate and said second elongated plate towards one another to a ball clamping position and for selectively moving said first elongated plate and second elongated plate away from one another to a ball adjustment position;

said lower ball sockets of said first elongated plate and said second elongated plate configured to receive said first ball member of said first ball joint member therebetween;

a forearm support having upper and lower ends;

said forearm support having a ball secured to its said lower end;

said ball of said forearm support being received between said upper ball sockets of said first and second plates;

said forearm support being movable in a swivel manner with respect to said first elongated plate and said second elongated plate of said double-ball mounting assembly; and said first elongated plate and said second elongated plate being mounted on said first ball member of said ball joint member in a swivel manner.

* * * * *